US009139005B2

(12) United States Patent
Nagaoka et al.

(10) Patent No.: US 9,139,005 B2
(45) Date of Patent: Sep. 22, 2015

(54) LIQUID EJECTION HEAD AND PROCESS FOR PRODUCING THE SAME

(71) Applicant: CANON KABUSHIKI KAISHA, Tokyo (JP)

(72) Inventors: Kyosuke Nagaoka, Kodaira (JP); Isamu Horiuchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/178,513

(22) Filed: Feb. 12, 2014

(65) Prior Publication Data

US 2014/0285577 A1 Sep. 25, 2014

(30) Foreign Application Priority Data

Mar. 22, 2013 (JP) ..... 2013-060009

(51) Int. Cl.
*B41J 2/14* (2006.01)
*B41J 2/16* (2006.01)

(52) U.S. Cl.
CPC ..... *B41J 2/1631* (2013.01); *B41J 2/1404* (2013.01); *B41J 2/1603* (2013.01); *B41J 2/1639* (2013.01); *B41J 2/1645* (2013.01); *B41J 2/1433* (2013.01); *B41J 2002/14387* (2013.01)

(58) Field of Classification Search
None
See application file for complete search history.

(56) References Cited

U.S. PATENT DOCUMENTS 5,761,783 A * 6/1998 Osawa et al. ..... 29/25.35
8,061,809 B2 * 11/2011 Ikegame et al. ..... 347/47

FOREIGN PATENT DOCUMENTS

JP 2003080717 A 3/2003

OTHER PUBLICATIONS

Definition of "depression" from Merriam-Webster's Online Dictionary retrieved on Jan. 23, 2015, see definition 3.*
Definition of "serrate" from Merriam-Webster's Online Dictionary retreived on Jan. 26, 2015, see Synonyms.*

* cited by examiner

*Primary Examiner* — Lisa M Solomon
(74) *Attorney, Agent, or Firm* — Fitzpatrick, Cella, Harper & Scinto

(57) ABSTRACT

A liquid ejection head includes a substrate on a surface of which an energy-generating element for generating energy for ejecting liquid is formed; and a flow path forming member formed on the substrate, the flow path forming member forming an ejection orifice for ejecting the liquid and a liquid flow path communicating with the ejection orifice. The flow path forming member includes, at a position surrounding the liquid flow path, a depression that opens to an upper surface of the flow path forming member and a groove that opens to the first depression. The angle between the upper surface of the flow path forming member and a slope surface of the depression on the flow path forming member side is an obtuse angle. The groove has a serrated side wall.

7 Claims, 7 Drawing Sheets

FIG. 1A
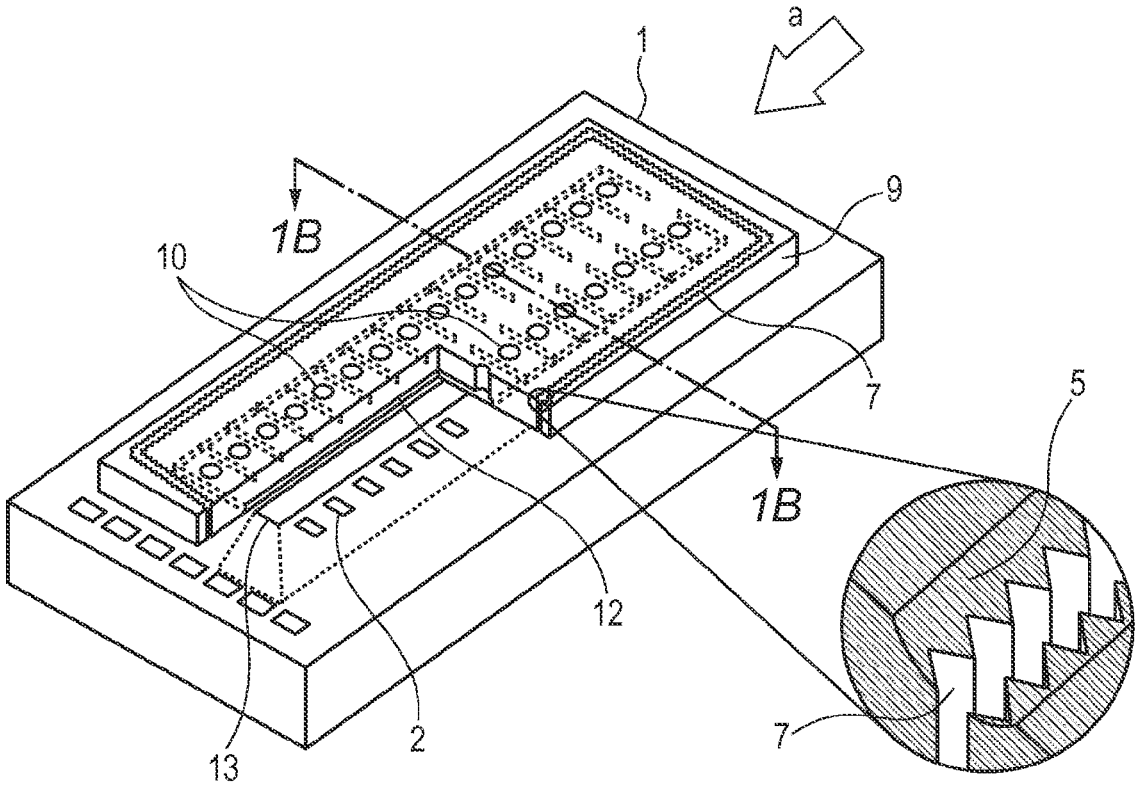
FIG. 1AP
FIG. 1B
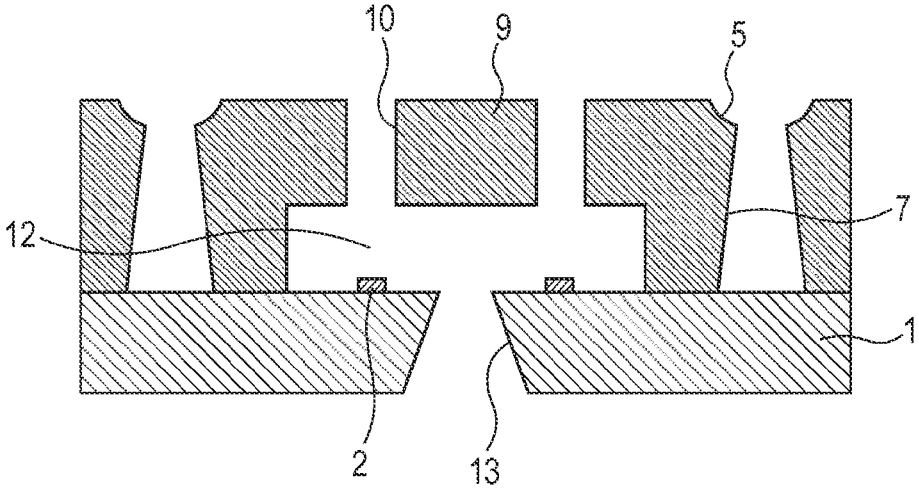

LIQUID EJECTION HEAD AND PROCESS FOR PRODUCING THE SAME

BACKGROUND OF THE INVENTION

1. Field of the Invention

The present invention relates to a liquid ejection head that ejects liquid such as ink, and a process for producing the same.

2. Description of the Related Art

A liquid ejection recording apparatus (ink jet recording apparatus) for ejecting a minute ink droplet from a minute ejection orifice is a mode of a recording apparatus for forming an image (in this case, a letter, a figure, a pattern, and the like are collectively referred to as an image, no matter whether they are meaningful or meaningless) on a recording medium such as recording paper. In general, a liquid ejection recording apparatus includes a liquid ejection head having an ejection orifice for ejecting an ink droplet, and an ink tank for holding ink to be supplied to the liquid ejection head. Ink is introduced from the ink tank to the liquid ejection head. An energy-generating element, for example, a heat generating element or a piezoelectric element, which is provided in a pressure chamber of the liquid ejection head, is driven based on a recording signal. Recording is performed by an ink droplet which is ejected from the ejection orifice onto a recording material. The liquid ejection recording apparatus is a so-called non-impact recording apparatus which has advantages including the ability of recording at high speed, the ability of recording on various kinds of recording media, and causing almost no noise in recording, and thus, is in widespread use.

In recent years, a still higher output speed of a printer is required, partly because in association with improvement in processing speed of a computer and a more minute ink droplet for the purpose of outputting a finer image, a higher ink droplet density is required. Demand for a higher speed of a large-scale printer or a networked printer is further prominent. A higher output speed of a printer can be attained by two factors: increase in the number of generated ink droplets per unit time, that is, increase in the ink ejection frequency; and increase in the number of the ink ejection orifices. Typically, a higher output speed of a printer is attained by both of the two factors. However, increase in the number of the ink ejection orifices means increase in the width of a nozzle array, which results in a longer liquid ejection head.

As described above, in order to provide a large number of ink ejection orifices, a production process is suitable in which a flow path forming member is formed of a photosensitive resin and the ejection orifices are formed by photolithography. However, when a flow path forming member is formed of a resin, as the liquid ejection head becomes longer, internal stress of the flow path forming member increases due to cure shrinkage and difference in linear expansion coefficient between a substrate and the photosensitive resin to form the flow path forming member. The internal stress may separate the substrate and the flow path forming member.

Accordingly, Japanese Patent Application Laid-Open No. 2003-80717 proposes a structure in which a groove which surrounds a liquid flow path is formed in the flow path forming member and side walls of the groove are formed in a serrated form with multiple minute serrations. Such a structure reduces stress on an ejection orifice plate to prevent separation of the flow path forming member even if the liquid ejection head is long.

SUMMARY OF THE INVENTION

According to one embodiment of the present invention, there is provided a liquid ejection head, including:

a substrate on a first surface of which an energy-generating element for generating energy for ejecting liquid is formed; and a flow path forming member formed on the substrate, the flow path forming member forming an ejection orifice for ejecting the liquid and a liquid flow path communicating with the ejection orifice, in which:

the flow path forming member includes, at a position surrounding the liquid flow path, a first depression that opens to an upper surface of the flow path forming member and a groove that opens to the first depression;

an angle between the upper surface of the flow path forming member and a slope surface of the first depression on the flow path forming member side is an obtuse angle; and the groove has a serrated side wall.

Further, according to one embodiment of the present invention, there is provided a process for producing a liquid ejection head, the liquid ejection head including:

a substrate on a first surface of which an energy-generating element for generating energy for ejecting liquid is formed; and a flow path forming member formed on the substrate, the flow path forming member forming an ejection orifice for ejecting the liquid and a liquid flow path communicating with the ejection orifice, the flow path forming member including, at a position surrounding the liquid flow path, a first depression that opens to an upper surface of the flow path forming member and a groove that opens to the first depression, the groove having a serrated side wall, the process including:

(1) forming, on the first surface of the substrate, a soluble resin layer including a flow path mold pattern that is a mold material for the liquid flow path and a base pattern surrounding the flow path mold pattern, by using a soluble resin;

(2) forming a coating resin layer composed of a photosensitive resin on the substrate and the soluble resin layer;

(3) forming the first depression in an upper surface of the coating resin layer along the base pattern;

(4) forming, on the coating resin layer, a first latent image corresponding to the groove and a second latent image corresponding to the ejection orifice; and (5) developing the first latent image and the second latent image and removing the soluble resin layer, in which an angle between the upper surface of the coating resin layer and a slope surface of the first depression on the coating resin layer side is an obtuse angle.

Further features of the present invention will become apparent from the following description of exemplary embodiments.

BRIEF DESCRIPTION OF THE DRAWINGS

FIGS. 1A and 1AP are schematic perspective views and FIG. 1B is a schematic sectional view illustrating an exemplary structure of an ink jet recording head according to an embodiment of the present invention.

DESCRIPTION OF THE EMBODIMENTS

With regard to the liquid ejection head described in Japanese Patent Application Laid-Open No. 2003-80717, there are some cases in which a blade is worn more at a portion corresponding to the groove provided in a serrated form. There is a tendency that the wear appears conspicuous particularly when there is a swell at a tip of a serration or when the width of the groove is large.

Accordingly, an object of the present invention is to provide a liquid ejection head having a serrated groove with less wear on a blade and with less liability to cause image disorder even in prolonged use, and a process for producing the same.

A liquid ejection head according to the present invention can be mounted on a printer, a copying machine, a fax machine having a communication system, an apparatus such as a word processor including a printer portion, and further, an industrial recording apparatus integrated with a processing apparatus of various kinds. By using the liquid ejection head, recording can be performed on various kinds of recording media such as paper, thread, fabric, leather, metal, plastic, glass, wood, and ceramics. Note that, "recording" as used herein means not only giving a meaningful image such as a letter or a shape but also giving a meaningless image such as a pattern to a recording medium. Further, "liquid" as used herein shall be broadly construed, and means liquid which is, by being given onto a recording medium, available for formation of an image, a pattern or the like, processing of a recording medium, or treatment of ink or a recording medium. The treatment of ink or a recording medium includes, for example, improvement in fixing property by solidification or insolubilization of a coloring material in ink given to a recording medium, improvement in recording quality or color reproducing performance, and improvement in image durability.

Further, in the following description, an ink jet recording head is taken as a main example of a liquid ejection head to which the present invention is applied, but the application range of the present invention is not limited thereto, and the present invention may also be applied to a process for producing a liquid ejection head for producing a biochip or for printing an electronic circuit in addition to an ink jet recording head. The present invention may also be applied to, for example, a process for producing a liquid ejection head for producing a color filter.

An exemplary structure of a liquid ejection recording apparatus of an embodiment according to the present invention is described in the following with reference to the attached drawings.

Figure 10:
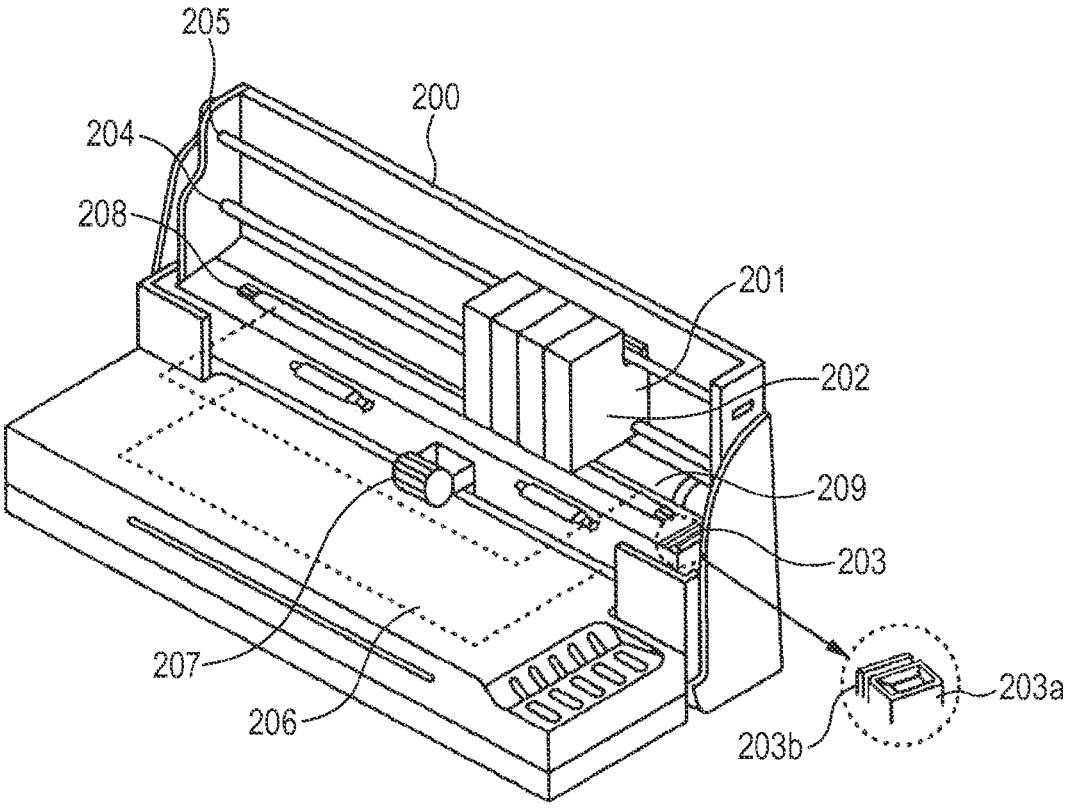
FIG. 10 is a schematic perspective view illustrating a structure of an ink jet recording apparatus having an ink jet cartridge mounted thereon according to an embodiment of the present invention.

FIG. 10 is a schematic view illustrating a structure of an ink jet recording apparatus 200 having an ink jet cartridge mounted thereon according to this embodiment.

In the ink jet recording apparatus illustrated in FIG. 10, multiple ink jet cartridges 202 are mounted on a carriage 201 held by a guide shaft 205 and a lead screw 204. An image is recorded on a recording sheet 206 while the carriage 201 is reciprocated right and left.

The guide shaft 205 is a fixed shaft which serves as a guide when the carriage 201 is reciprocated right and left.

The lead screw 204 is a rotating shaft having a spiral groove (not shown) formed therearound. By rotating the lead screw in a normal direction and in a reverse direction, the carriage 201 can be reciprocated right and left.

The recording sheet 206 is stacked in a lower portion of the ink jet recording apparatus 200, and is fed by a sheet feed roller 207 through under a sheet bail 209 to a printing portion of the ink jet recording apparatus 200.

While an image is recorded by the ink jet cartridges 202 on the recording sheet 206, a sheet discharge roller 208 advances the recording sheet 206 only by the required printing region and, ultimately, discharges the recording sheet 206 from the ink jet recording apparatus 200.

Before or while an image is recorded by the ink jet cartridges 202 on the recording sheet 206, recovery operation of the ink jet cartridges 202 is performed by a recovery unit 203 so that the image recording quality is not deteriorated. The recovery unit 203 includes a cap 203*a* which can be brought into abutment against a surface of the head in which ejection orifices are provided to perform recovery of the head by suction and a blade 203*b* for performing wiping cleaning of the surface of the head in which the ejection orifices are provided.

A liquid ejection head according to an embodiment of the present invention is described in the following.

FIG. 1A is a partially transparent schematic view illustrating a structure of an ink jet recording head according to this embodiment. FIG. 1B is a schematic sectional view taken along the line 1B-1B of FIG. 1A along a plane perpendicular to a substrate plane.

The ink jet recording head according to this embodiment includes a substrate 1 on a first surface (front surface) of which energy-generating elements 2 for generating energy for ejecting ink are formed at a predetermined pitch. The substrate 1 has a supply port 13 formed therein for supplying ink to an ink flow path (liquid flow path) 12. The supply port 13 opens between two arrays of the energy-generating elements 2. The substrate 1 has a flow path forming member 9 provided thereon in which ejection orifices 10 that respectively open above the energy-generating elements and a liquid flow path 12 that communicates from the supply port 13 to the respective ejection orifices 10 are formed. The ink jet recording head ejects ink droplets through the ejection orifices 10 by applying ejection energy such as pressure which is generated by the energy-generating elements 2 to ink which is supplied from the supply port 13 through the liquid flow path 12. The liquid flow path is a concept which includes a pressure chamber.

Further, as illustrated in FIG. 1AP, in the ink jet recording head of this embodiment, a depression 5 which opens to an upper surface (also referred to as ejection surface) of the flow path forming member 9 and a groove 7 which opens to the depression 5 are formed in the flow path forming member 9 at a position surrounding the liquid flow path 12. Further, the groove 7 has serrated side walls having multiple minute serrations. The serrations of the side walls are placed along an extending direction of the groove.

As illustrated in the figures, in the liquid ejection head of this embodiment, the side walls of the groove are formed in a serrated form. The formation of the side walls of the groove in a serrated form can alleviate stress to be applied on the flow path forming member to inhibit separation of the flow path forming member. With regard to the serrated side walls in this embodiment, the description in Japanese Patent Application Laid-Open No. 2003-80717 may be referred to in addition to the description made herein. For example, the edge portion of the groove does not have a continuous portion which is perpendicular to the direction of stress to be applied on the edge portion of the groove. Further, the serrations provided in the edge portion of the groove may include a combination of straight lines so that the straight lines do not have a portion which is perpendicular to the direction of stress to be applied on the edge portion of the groove. Alternatively, the serrations provided in the edge portion of the groove may include a combination of curves so that tangents of the curves do not have a continuous portion which is perpendicular to the direction of stress to be applied on the edge portion of the groove. Alternatively, the serrations provided in the edge portion of the groove may include a combination of straight lines and curves so that the straight lines do not have a portion which is perpendicular to the direction of stress to be applied on the edge portion of the groove while tangents of the curves do not have a continuous portion which is perpendicular to the direction of stress to be applied on the edge portion of the groove.

Further, in this embodiment, the flow path forming member has the groove at a position surrounding the liquid flow path, and the groove has the serrated side walls from a position below an upper surface of the flow path forming member. Further, in this embodiment, the flow path forming member has the groove at a position surrounding the liquid flow path, and the groove has the serrated side walls from a position below the upper surface of the flow path forming member (position nearer to the substrate) toward the substrate, and slopes from upper ends of the serrated side walls to the upper surface of the flow path forming member.

Ink adhering to the vicinity of the ejection orifices can be wiped away in a direction shown by the arrow 'a' in FIG. 1A by a blade (not shown).

In the liquid ejection head of this embodiment, the flow path forming member 9 has the groove 7 formed therein so as to surround the liquid flow path 12 as described in Japanese Patent Application Laid-Open No. 2003-80717. The groove 7 is placed under the depression 5 so as to open to the depression 5 provided in the upper surface of the flow path forming member. The groove 7 having the serrated side walls has the function of alleviating stress.

Figure 7A:
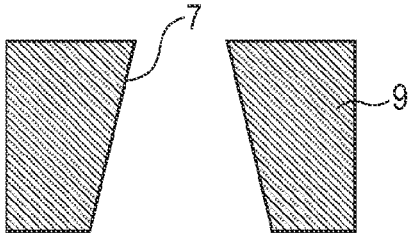
FIGS. 7A and 7B are schematic sectional views illustrating exemplary shapes in section around the ejection orifice of the ink jet recording head of the embodiment.
Figure 7B:
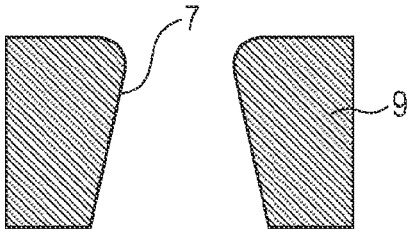

As described above, in the liquid ejection head described in Japanese Patent Application Laid-Open No. 2003-80717, image disorder has sometimes appeared in prolonged use due to unwiped ink caused by wiping failure on the ejection surface. Further, detailed investigation revealed that the wiping failure was caused by local wear on the blade, and the wear on the blade appeared conspicuous at portions on the ejection surface corresponding to the groove provided in a serrated form. This is thought to be because, particularly when the ejection orifices and the groove are simultaneously formed under a state in which a focus of exposure is set around an upper surface of a coating resin layer, the shape in section of the serrated side walls at edges of the opening forms acute angles (see FIG. 7A), which is gradually chipped away in wiping. This phenomenon tends to have a conspicuous influence when there is a swell at a tip of a serration or when the width of the groove is large. On the other hand, according to this embodiment, the opening of the groove 7 is placed within the depression, and thus, wear on the blade can be prevented.

A process for forming the depression 5 is not specifically limited, and various techniques can be adopted. However, depending on the position of the depression, interference with the ejection orifice arrays may be caused, and thus, it is desired that the depression 5 be formed by photolithography.

Next, a process for producing the ink jet recording head of this embodiment is described in the following with reference to FIGS. 2A to 2H.

FIGS. 2A to 2H are schematic sectional views taken along the line 1B-1B of FIG. 1A illustrating a structure of the ink jet recording head along the plane perpendicular to the surface of the substrate, and are process sectional views illustrating an exemplary process for producing the ink jet recording head of this embodiment.

Figure 2A:
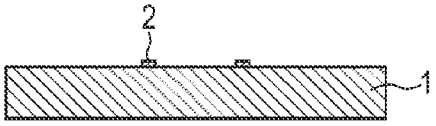
FIGS. 2A, 2B, 2C, 2D, 2E, 2F, 2G, and 2H are process sectional views for illustrating exemplary steps of a process for producing the ink jet recording head of the embodiment.

First, as illustrated in FIG. 2A, a substrate 1 having an energy-generating element 2 formed on the first surface thereof is prepared.

As the substrate 1, typically a silicon substrate is used. The energy-generating element 2 is not specifically limited insofar as ejection energy for ejecting liquid is generated. Exemplary energy-generating elements include heat-generating resistance elements. A heat-generating resistance element ejects liquid through an ejection orifice by heating nearby liquid to cause change in the state of the liquid. Note that, a control signal input electrode (not shown) for operating the energy-generating element 2 is connected thereto. Further, generally, various kinds of functional layers including a protective layer (not shown) for the purpose of improving the durability of the energy-generating element 2 and an adhesiveness improving layer (not shown) for the purpose of improving the adhesiveness between the flow path forming member and the silicon substrate to be described later are provided. Of course, it causes no problem to provide such functional layers on the substrate according to the present invention.

Figure 2B:
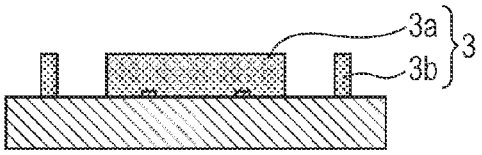

Next, as illustrated in FIG. 2B, a soluble resin layer 3 is provided on the substrate 1. The soluble resin layer 3 includes a flow path mold pattern 3*a* which is a mold material of the liquid flow path and a base pattern 3*b* which surrounds the flow path mold pattern.

The soluble resin layer 3 can be formed by using a soluble resin, and for example, a positive resist that becomes soluble in a developing agent through light irradiation can be used. The following photodegradable polymer compounds can be suitably used as the positive resist: a vinyl ketone-based photodegradable polymer compound such as polymethyl isopropenyl ketone or polyvinyl ketone; and an acrylic photodegradable polymer compound. Examples of the acrylic photodegradable polymer compound include: a copolymer of methacrylic acid and methyl methacrylate; and a copolymer of methacrylic acid, methyl methacrylate, and methacrylic anhydride. In addition, exemplary processes for applying the soluble resin include general processes such as spin coating, slit coating, and the like.

The thickness of the soluble resin layer 3 may be a desired height of the liquid flow path, and is not specifically limited, but it is preferred that the thickness of the soluble resin layer 3 be, for example, 2 μm to 50 μm.

Figure 2C:
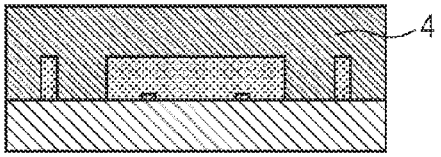

Then, as illustrated in FIG. 2C, a coating resin layer 4 of a photosensitive resin is provided on the soluble resin layer 3.

As the photosensitive resin, a negative photosensitive resin may be used.

It is desired to select the material of the coating resin layer 4 in consideration of characteristics of a cured product such as mechanical strength, ink resistance, adhesiveness with a base layer, resolution as a photolithography material, and the like. Based on those characteristics, as the material of the negative photosensitive resin layer, a cationic polymerizable epoxy resin composition may be suitably used. As the cationic polymerizable epoxy resin composition, there is suitably used a photo-cationic polymerizable epoxy resin composition based on an epoxy resin such as a bisphenol A type epoxy resin, a phenol novolac type epoxy resin, a cresol novolac type epoxy resin, or a polyfunctional epoxy resin having an oxycyclohexane skeleton. By using the epoxy resin having two or more epoxy groups, the cured product thereof can be three-dimensionally crosslinked, which is suitable for providing desired characteristics. As a commercially available epoxy resin, there are given, for example: "CELLOXIDE 2021", "GT-300 series", "GT-400 series", and "EHPE3150" (all of which are trade names) produced by Daicel Corporation; "157S70" (trade name) produced by Japan Epoxy Resin Corporation; and "Epiclon N-865" (trade name) produced by DIC Corporation.

A photopolymerization initiator to be added to the epoxy resin composition is preferably a photoacid generating agent that generates an acid by absorbing light, more preferably a sulfonic acid compound, a diazomethane compound, a sulfonium salt compound, an iodonium salt compound, or a disulfone-based compound. As a commercially available photopolymerization initiator, there are given, for example: "ADEKA OPTOMER SP-170", "ADEKA OPTOMER SP-172", and "SP-150" (all of which are trade names) produced by ADEKA CORPORATION; "BBI-103" and "BBI-102" (all of which are trade names) produced by Midori Kagaku Co., Ltd.; and "IBPF", "IBCF", "TS-01", and "TS-91" (all of which are trade names) produced by SANWA Chemical Co., Ltd. Further, the above-mentioned epoxy resin composition may contain a basic substance such as an amine, a photosensitizing substance such as an anthracene derivative, or a silane coupling agent, for the purpose of improving the photolithography performance, the adherence performance, or the like. Further, as the negative resist, for example, a commercially-available negative resist, such as "SU-8 series" produced by Kayaku MicroChem Co., Ltd. and "TMMR S2000" and "TMMF S2000" (all of which are trade names) produced by TOKYO OHKA KOGYO Co., Ltd. can also be used.

Exemplary processes for providing the coating resin layer 4 on the soluble resin layer 3 include application by spin coating or the like of a solution prepared by dissolving, in a solvent, a negative photosensitive resin which is solid at room temperature.

When the surface in which the ejection orifices are formed droops in the vicinity of a region of the negative photosensitive resin layer 4 to be an ejection orifice, the direction of ejection may be deviated at that portion, and thus, it is desired that the negative photosensitive resin layer 4 be formed flat on the soluble resin layer 3. In this embodiment, the flow path mold pattern 3*a* which is the mold material of the liquid flow path and the base pattern 3*b* which surrounds the flow path mold pattern support the photosensitive resin, and thus, the surface of the photosensitive resin layer including the vicinity of the ejection orifices may be formed flat.

The solvent for applying the photosensitive resin is not specifically limited, and an organic solvent may be used. Examples of the organic solvent may include: alcohol-based solvents such as ethanol and isopropyl alcohol; ketone-based solvents such as acetone, methyl isobutyl ketone, diisobutyl ketone, and cyclohexanone; aromatic solvents such as toluene, xylene, and mesitylene; ethyl lactate; propylene glycol monomethyl ether; diethylene glycol monomethyl ether; and diethylene glycol dimethyl ether. One kind of those solvents may be used alone, or two or more kinds thereof may be mixed and used.

Further, surface modification treatment such as a water-repellent treatment, a hydrophilic treatment, and the like may be performed on a surface of the coating resin layer 4 as required.

Further, with regard to the thickness of the negative photosensitive resin layer 4, from the viewpoint of mechanical strength of the flow path forming member, it is preferred that a thickness T2 above the soluble resin layer 3 (hereinafter referred to as thickness of the ejection orifice plate, see FIG. 2F) be 3 μm or more. Further, while the upper limit of the thickness is not specifically limited, from the viewpoint of controlling the ejection orifice diameter with high accuracy and high yield using a technique of setting the focus of exposure around the ejection surface, the thickness is preferably 60 μm or less, and more preferably 40 μm or less. In general, there is a positive correlation between the thickness of the ejection orifice plate and the ejection orifice diameter, and there is a tendency for the ejection orifices to have a larger diameter as the ejection orifice plate becomes thicker. Therefore, when the thickness of the ejection orifice plate is 60 μm or less, the design value of the ejection orifice diameter is relatively small, and thus, when a highly accurate ejection orifice diameter is formed using the technique of setting the focus of exposure around the ejection surface, the influence on the print quality is great. Further, the ejection orifice diameter is preferably 30 μm or less, and more preferably 20 μm or less.

Figure 2D:
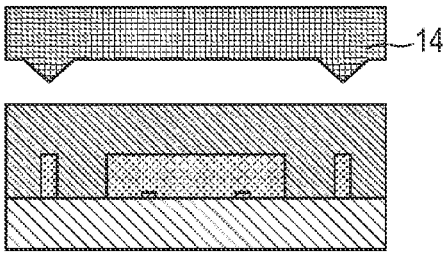
Figure 2E:
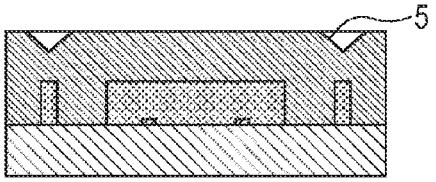

Then, as illustrated in FIGS. 2D and 2E, the depression 5 is formed in the coating resin layer along the base pattern.

More specifically, the depression 5 is provided in the coating resin layer 4 above and along the base pattern 3*b* which surrounds the flow path mold pattern 3*a*.

A process for providing the depression 5 is not specifically limited, but, for example, a molding process using a mold (master mold for forming a shape), i.e. imprinting, may be used (FIGS. 2D and 2E). Specifically, by pressing a mold 14 with a projection pattern of the depression 5 to be transferred onto the upper surface of the coating resin layer 4, the depression 5 can be formed. Further, the mold may be pressed onto the coating resin layer 4 under conditions where the mold temperature is 20° C. to 120° C. and the pressure is 0.01 MPa to 5 MPa. This enables transfer of the projection pattern to the coating resin layer 4. In typical imprinting, the mold is heated to a temperature equal to or higher than the glass transition temperature of the resin to which the pattern is to be transferred, and the pattern is transferred under a pressure of several megapascals. However, in this case, the aspect ratio of the pattern is small, and it is not necessary to transfer the depression 5 deep into the coating resin layer 4, and thus, patterning with a relatively low temperature and a relatively low pressure is possible. The base material of the mold 14 is not specifically limited, but various kinds of materials such as various kinds of metal materials, glass, ceramics, silicon, quartz, and photosensitive resins may be used.

The depression is formed in the upper surface of the coating resin layer so as to surround the liquid flow path. The shape in section along a plane perpendicular to an extending direction of the depression is not specifically limited, and may be triangular, quadrangular including trapezoidal, catenary, or the like. Further, it is preferred that the angle formed by the upper surface of the resin layer and the slope of the depression in section along the plane perpendicular to the extending direction of the depression (θ in FIG. 5B) be an obtuse angle, and it is preferred that the angle be 100° or more. The coating resin layer ultimately becomes the flow path forming member. Therefore, it is preferred that the angle between the upper surface of the flow path forming member and a slope surface of the depression on the flow path forming member side be an obtuse angle. Further, it is preferred that the angle be 100° or more.

With regard to the depth of the depression 5, from the viewpoint of being less liable to cause image disorder even in prolonged use, the depth of the deepest portion is preferably 1 μm or more and more preferably 3 μm or more. Further, the depth of the depression 5 at an inner edge position in a region to be the serrated groove 7 is preferably 1 μm or more and more preferably 3 μm or more.

The width of the depression 5 (d1 in FIG. 5A) is not specifically limited insofar as the depression 5 does not overlap with regions to be the ejection orifice from the viewpoint of ejection stability, and, for example, in the range of 40 μm to 400 μm.

Figure 2F:
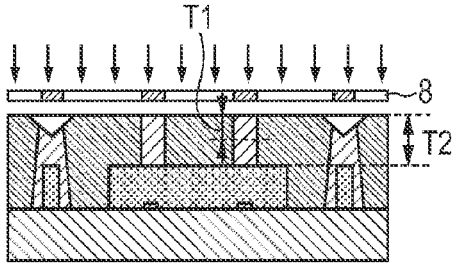

Then, as illustrated in FIG. 2F, a first latent image corresponding to the groove 7 and a second latent image corresponding to the ejection orifice are formed on the coating resin layer 4.

More specifically, the coating resin layer 4 is subjected to pattern exposure through a photomask 8 having an exposure pattern which includes a groove pattern with the serrated side walls and an ejection orifice pattern. At this time, it is preferred that the coating resin layer of a negative photosensitive resin be subjected to pattern exposure under a state in which the focus of exposure is set around an upper surface of the flow path forming member to be the ejection surface (between the upper surface of the coating resin layer and a position which is 10 μm away from the upper surface toward the substrate).

After that, heat treatment (post exposure bake, hereinafter also referred to as PEB) may be further performed at a temperature equal to or higher than the softening point of the photosensitive resin.

When a negative photosensitive resin is used as the coating resin layer, the first latent image and the second latent image are formed in unexposed portions, and exposed portions are cured.

Further, the photomask 8 is formed by forming a light-shielding film, such as a chromium film, on a substrate made of a material which transmits light having the wavelength of the exposure such as glass or quarts, such that the light-shielding film corresponds to portions where the negative photosensitive resin is not cured such as the ejection orifice or the groove.

As an exposure apparatus, for example, a projection exposure apparatus may be used. Specifically, as the exposure apparatus, a projection exposure apparatus which has a focusing function, and a light source of a single wavelength such as an I-ray exposure stepper or a KrF stepper, or a light source having a broad wavelength of a mercury lamp such as Mask Aligner MPA-600 Super (trade name, produced by Canon Inc.) may be used. In these projection exposure apparatus, light which is emitted from the light source and which passes through the mask is collected through a projection lens to expose the photosensitive resin on the substrate. The focus of exposure as used herein means a focus of light collected through a projection lens. By measuring in advance the position of a surface of the coating resin layer to be the ejection surface and moving the substrate to a specified position, the position of the focus of exposure may be arbitrarily specified in exposure.

Figure 9A:
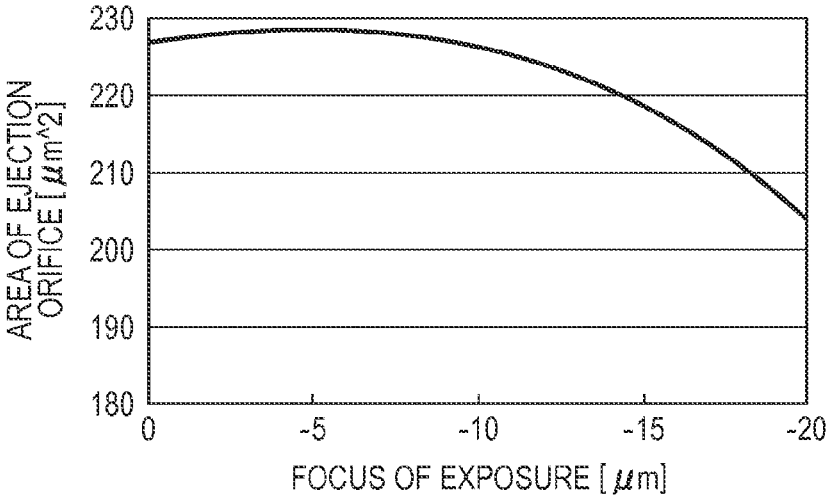
FIGS. 9A and 9B are graphs showing the relationship between a position of a focus of exposure and the area of the ejection orifice of the ink jet recording head of the embodiment.
Figure 9B:
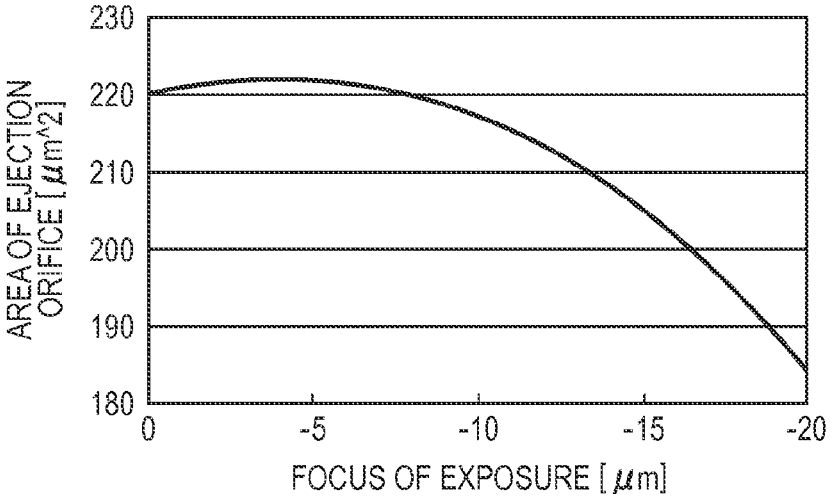

At this point, as described above, according to this embodiment, it is preferred that the focus of exposure in exposing the coating resin layer be set between the upper surface of the coating resin layer and the position which is 10 μm away from the upper surface toward the substrate (T1 in FIG. 2F). FIGS. 9A and 9B show change in ejection orifice diameter when the position of the focus of exposure is moved from the upper surface of the negative photosensitive resin layer with use of a mask having a diameter of 15.7 μm. FIG. 9A shows change in ejection orifice diameter when the thickness T2 of the ejection orifice plate is 15 μm, while FIG. 9B shows change in ejection orifice diameter when the thickness T2 of the ejection orifice plate is 25 μm. Note that, the position of the focus of exposure is expressed as positive in a direction from the substrate toward the upper surface of the resin layer with reference to the upper surface of the resin layer. In both cases, change in ejection orifice diameter is small when the focus of exposure is set between the upper surface of the resin layer and the position which is 10 μm away from the upper surface toward the substrate. It can be seen that, when the focus of exposure is set in this range, even if the thickness of the ejection orifice plate varies to some extent on the substrate, variations in ejection orifice diameter may be reduced. On the other hand, it can be seen that, in both cases, change in ejection orifice diameter tends to become large when the position of the focus of exposure is more than 10 μm away from the upper surface. Further, when the focus of exposure is set above the ejection surface, the shape of the ejection orifices tends to be deformed.

Figure 2G:
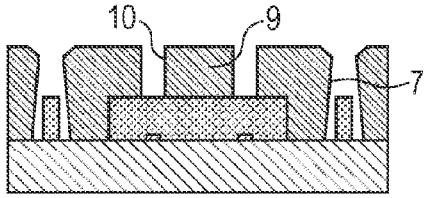

Then, as illustrated in FIG. 2G, the first latent image and the second latent image are developed.

More specifically, by developing the unexposed portions of the negative photosensitive resin, the ejection orifices 10 and the groove 7 which has the serrated side walls are formed.

For example, methyl isobutyl ketone (MIBK) and xylene can be used as a developing agent, and rinse treatment with, for example, isopropyl alcohol (IPA) and a postbake may be performed as required.

Figure 4A:
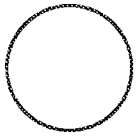
FIGS. 4A, 4B, and 4C are schematic views illustrating exemplary shapes of an opening of an ejection orifice on an ejection surface side of the ink jet recording head of the embodiment.
Figure 4B:
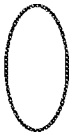
Figure 4C:
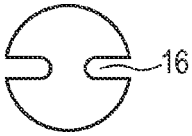

The shape of the ejection orifices in this embodiment may be, taking into consideration ejecting characteristics and the like, appropriately selected. For example, the shape may be as illustrated in FIGS. 4A, 4B, and 4C. In particular, when an ejection orifice 10 having projections 16 therein as illustrated in FIG. 4C are used, by holding liquid between the projections 16, breakup of an ink droplet into multiple droplets (main droplet and satellite droplets) when ejected may be drastically reduced to realize high quality printing.

Figure 2H:
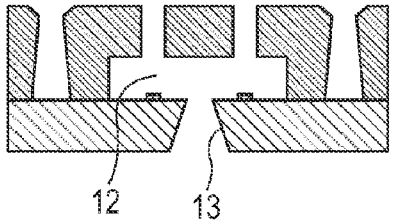

Then, as illustrated in FIG. 2H, an alkaline etchant is used to form the supply port 13. After that, the soluble resin layer 3 is dissolved and removed to form the liquid flow path 12.

After that, as necessary, heat treatment is performed in order to cause the flow path forming member 9 to be harder, and the ink jet recording head is completed.

The depression 5 may also be formed using patterning of the negative photosensitive resin by photolithography.

Further, by applying the technique of forming the depression by photolithography according to this embodiment, the ejection orifices may be formed in a tapered shape.

Another process for producing the ink jet recording head according to this embodiment is described in the following with reference to FIGS. 3A to 3H.

FIGS. 3A to 3H are schematic sectional views taken along the line 1B-1B of FIG. 1A illustrating a structure of the ink jet recording head along the plane perpendicular to the surface of the substrate, and are process sectional views illustrating another exemplary process for producing the ink jet recording head of this embodiment.

Figure 3A:
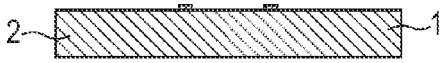
FIGS. 3A, 3B, 3C, 3D, 3E, 3F, 3G, and 3H are process sectional views for illustrating exemplary steps of another process for producing the ink jet recording head of the embodiment.
Figure 3B:
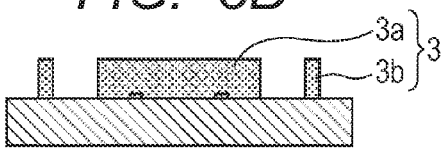
Figure 3C:
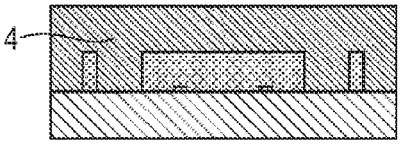

Steps illustrated in FIGS. 3A to 3C are the same as those illustrated in FIGS. 2A to 2C described above.

Figure 3D:
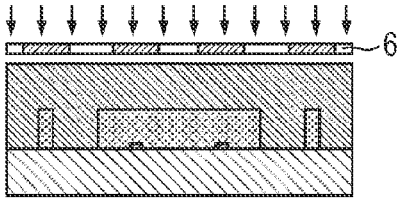
Figure 3E:
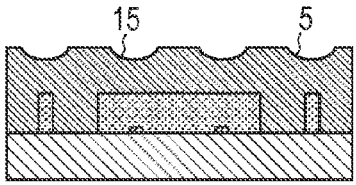

In FIGS. 3D and 3E, the depression 5 is formed in the upper surface of the negative photosensitive resin layer 4 along the base pattern 3*b* which is arranged and shaped to surround the flow path mold pattern 3*a*. Simultaneously with the formation of the depression 5, a depression 15 is formed in the upper surface of the negative photosensitive resin layer 4 so as to include regions in which the ejection orifice is to be formed. In the following, the depression 5 under which the groove 7 is to be formed is referred to as a first depression, while the depression 15 under which the ejection orifice is to be formed is referred to as a second depression.

The first depression 5 and the second depression may be provided as follows, for example. First, portions except the region in which the first depression 5 is to be formed and the regions in which the second depression 15 is to be formed are exposed through a photomask 6 by photolithography with an exposure light amount with which the negative photosensitive resin layer 4 is cured (FIG. 3D). After that, by performing heat treatment (PEB) at a temperature equal to or higher than the softening point of the negative photosensitive resin layer 4, the first depression 5 where the groove 7 is to be formed and the second depressions 15 where the ejection orifice is to be formed may be simultaneously provided (FIG. 3E). The shapes and the layout of the first depression 5 and the second depression 15 may be appropriately selected in accordance with the head form to be used. The depth of the depressions may be controlled by the exposure light amount, the temperature of the heat treatment (PEB), and the thickness of the negative photosensitive resin layer 4.

Further, the second depression 15 may include a region to be a single ejection orifice 10, and may include a region to be multiple ejection orifices 10.

Here, exemplary forms of the second depression 15 and the ejection orifice are described.

In FIGS. 11A to 11D, the second depression 15 is provided along a direction of an array of heaters 2 in a front surface (upper surface in the figures) of the flow path forming member 9. With regard to the shape of the second depression 15 in section along a plane perpendicular to the direction of the array of the heaters 2 (hereinafter also referred to as heater array direction) (corresponding to FIG. 11D), the surface of the second depression 15 is in a catenary shape, and the deepest portion of the second depression 15 is positioned at the center of the depression. Further, the depth of the deepest portion of the depression is constant in a region in which the array of the ejection orifices 10 is formed.

Figure 11A:
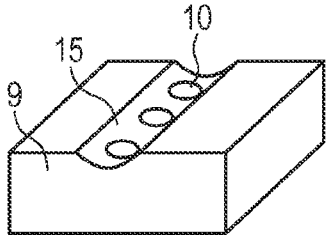
FIG. 11A is a schematic perspective view.
Figure 11B:
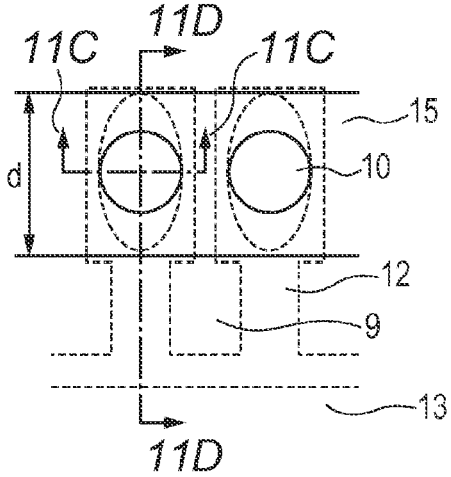
FIG. 11B is a schematic top view.
Figure 11C:
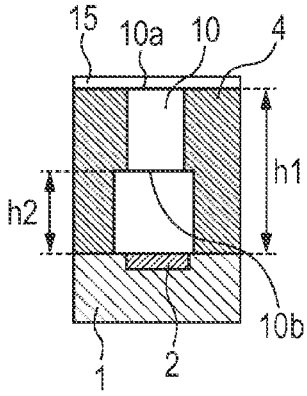
FIGS. 11C and 11D are schematic sectional views illustrating an exemplary structure of the ink jet recording head of the embodiment.
Figure 11D:
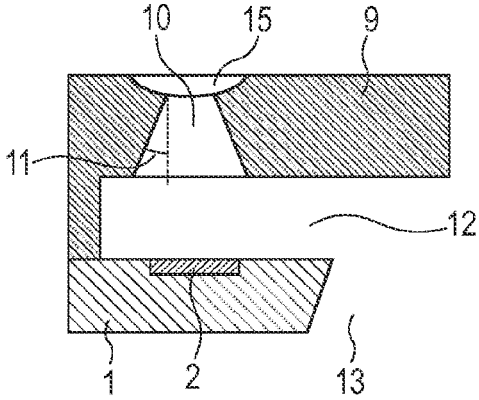

An outside opening 10*a* of the ejection orifice 10 is placed in the second depression 15. The center of the ejection orifice is positioned at the deepest portion of the second depression 15. As illustrated in FIG. 11B, the outside opening 10*a* of the ejection orifice 10 is in the shape of a circle, while an inside opening 10*b* of the ejection orifice 10 is in the shape of an oval. The cross-sectional area of the ejection orifices 10 along a plane in parallel with the surface of the substrate becomes smaller from the inside opening 10*b* (in particular, the lowermost portion of the opening) toward the outside opening 10*a*. Further, the centers of all the cross sections of the ejection orifice 10 along a plane in parallel with the surface of the substrate are coaxial. Further, as illustrated in FIG. 11C, in a cross section of the ejection orifice along a plane which includes a center line of the ejection orifices along the array direction (line corresponding to a dotted line 11C-11C in FIG. 11B) and which is perpendicular to the surface of the substrate (cross section corresponding to FIG. 11C), the angle between a side surface portion of the ejection orifice 10 and a normal of the outside opening 10*a* of the ejection orifice is almost 0°. On the other hand, in a cross section of the ejection orifice along a plane which passes through the center of the ejection orifice and which is perpendicular to the array direction of the ejection orifices (heater array direction) (cross section corresponding to FIG. 11D), a predetermined angle is formed between a side surface portion of the ejection orifice 10 and a normal of the outside opening 10*a* of the ejection orifice.

In the liquid ejection head obtained by this embodiment, the ejection orifice 10 is placed above the heater 2. The cross section of the ejection orifice 10 taken along the line 11D-11D is tapered so that the cross-sectional area of the ejection orifice 10 becomes gradually smaller from the inside opening 10*b* toward the outside opening 10*a*. It is preferred that an angle 11 between a side surface portion of the ejection orifice 10 and a normal of the outside opening 10*a* in the cross section along the plane perpendicular to the surface of the substrate be 5° or more and 20° or less in the cross section of the ejection orifice 10 taken along the line 11D-11D (that is, in the cross section along the plane which passes through the center of the ejection orifice and which is perpendicular to the heater array direction). Further, the angle 11 in the cross section of the ejection orifice 10 taken along the line 11D-11D may be larger than 20°. The angle 11 may be set differently with regard to each of the ejection orifices in accordance with the desired ejecting characteristics.

The depth of the second depression 15 may be adjusted by the exposure light amount in the exposure, the temperature and the time period of the heat treatment, the thickness of the flow path forming member, and the like. It is preferred that the depth of the deepest portion of the depression be constant in the region in which the array of the ejection orifices is formed. The temperature of the heat treatment is, for example, 60° C. to 150° C. The shape of the second depression in cross section along the plane perpendicular to the direction of the array of the ejection orifices is, for example, catenary.

Note that, in the description above, a case in which the second depressions are formed along the array direction is specifically described, but the present invention is not limited thereto, and the depression may be formed with regard to each of the ejection orifices. Further, it is enough that the second depressions have a slope on each side in the cross section along the plane perpendicular to the direction of the array of the ejection orifices.

Figure 3F:
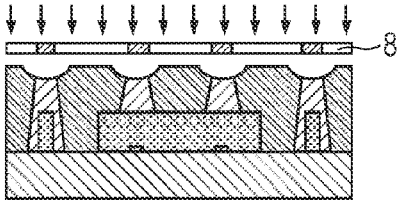
Figure 3G:
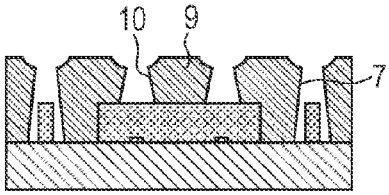
Figure 3H:
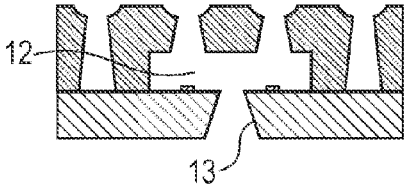

Steps illustrated in FIGS. 3F to 3H are the same as those illustrated in FIGS. 2F to 2H described above.

When, for the purpose of forming tapered ejection orifices, it is required to form depressions also for the ejection orifices, this technique is effective. By using this technique, the first depression 5 and the second depression 15 may be simultaneously formed. In other words, the production process according to the present invention can be performed without increasing the number of the steps therein. Further, according to this embodiment, a latent image of the ejection orifice is formed in the depression, and the latent images of the ejection orifice and the groove may be formed using the difference in refracting angle due to the slope of the depression.

Figure 5A:
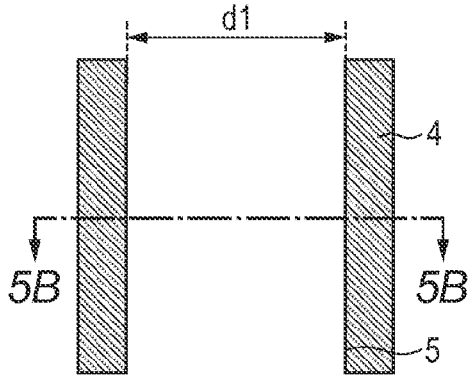
FIGS. 5A and 5B are schematic views illustrating an exposure principle in the process for producing the ink jet recording head of the embodiment.
Figure 5B:
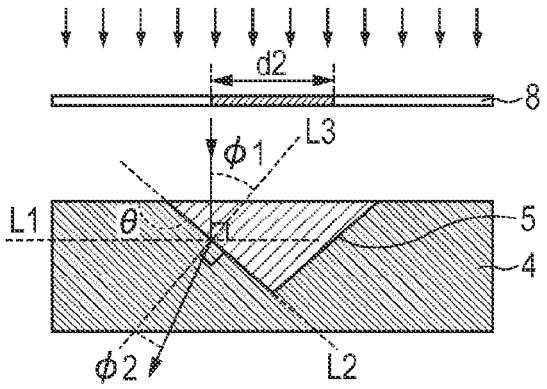

FIG. 5A is a schematic plan view of the negative photosensitive resin layer 4 having the depression 5 formed therein. FIG. 5B is a schematic sectional view taken along the line 5B-5B of FIG. 5A (structure other than the negative photosensitive resin layer is omitted).

In FIG. 5A, d1 is the width of the depression, while, in FIG. 5B, d2 is the width of a light-shielding portion of the photomask 8. In FIG. 5B, the light-shielding portion has a light shield pattern for forming the second latent image corresponding to the groove 7, and the photomask 8 is placed so that the central bottom portion of the depression 5 and the center of the light-shielding portion are coincident. Further, the width d1 of the depression 5 is formed so as to be larger than the width d2 of the light-shielding portion. As illustrated in FIG. 5B, light which enters the depression through the photomask 8 is refracted at the slope (L2) of the depression 5. In this case, the incident angle of light which enters the slope (L2) is an angle Φ1 formed between L3 perpendicular to the slope (L2) and the optical path of the incident light. When a line perpendicular to the incident light is represented by L1, an angle formed between L1 and L2 is equal to the incident angle Φ1. Using the Snell law of refraction, a refracting angle Φ2 of light which is refracted at L2 can be expressed as $n1 \sin \Phi1 = n2 \sin \Phi2$, where n1 is the refractive index of the depression 5 and n2 is the refractive index of the negative photosensitive resin layer 4. When n1 refers to the air, n1=1 is satisfied, and the refractive index n2 of the negative photosensitive resin layer 4 is equal to or larger than 1. It follows that $\Phi2<\Phi1$. Therefore, the second latent image formed of unexposed portions expands toward the bottom. The serrated groove 7 is tapered so that the cross-sectional area thereof becomes smaller toward the upper surface of the flow path forming member. Note that, the taper angle of the serrated groove 7 is not necessarily equal to the refracting angle Φ2 and depends on the optical conditions in the exposure, the refracting angle of a lens forming resin layer, and the like.

The same is true for the second depression 15 where the ejection orifice is to be made, and the ejection orifice may be tapered. When the ejection orifice 10 is in a tapered shape so that the cross-sectional area thereof becomes smaller from the liquid flow path side toward the upper surface side of the flow path forming member, the fluid resistance in the ejection orifice may be controlled to inhibit reduction in ink impact accuracy and ejection failure at the beginning of ejection.

Figure 8A:
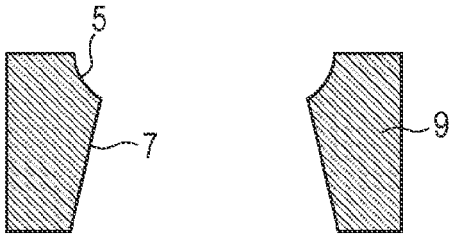
FIGS. 8A and 8B are schematic sectional views illustrating exemplary shapes in section of the groove of the ink jet recording head of the embodiment.
Figure 8B:
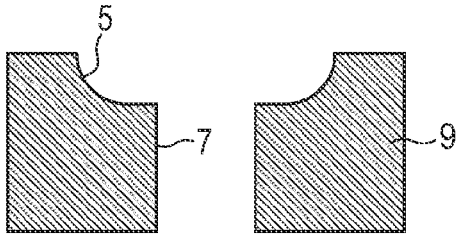

By exposing the slopes of the first depression 5 according to the above-mentioned principle, the serrated groove 7 is tapered so that the cross-sectional area thereof becomes smaller toward the upper surface of the flow path forming member (FIG. 8A). By forming the serrated groove 7 so as to be tapered in this way, stress on the flow path forming member may be alleviated. In particular, with regard to long liquid ejection heads and liquid ejection heads having a large number of orifices, there is an effect of inhibiting separation. Note that, the present invention is not limited to the serrated groove 7 having a tapered cross section, and, for example, by exposing a flat bottom surface of the depression 5, the serrated groove 7 may be formed into a straight shape in which the cross-sectional area is not changed (FIG. 8B).

Now, the present invention is described in detail by way of examples, but the present invention is not limited to the examples to be described below.

Note that, in the ink jet recording heads of Examples 1 to 7 and Comparative Examples 1 to 3, the thickness T2 of the ejection orifice plate is 40 μm and the diameter of the ejection orifices is 19 μm, and a long chip in which the ejection orifice plate is relatively thick and the ejection orifice diameter is relatively large is used.

Further, in Examples 8 to 12 and Comparative Example 4, the thickness T2 of the ejection orifice plate is 15 μm and the diameter of the ejection orifices is 12 μm, and a highly fine chip in which the ejection orifice plate is relatively thin and the ejection orifice diameter is relatively small is used.

Example 1

Through the steps illustrated in FIGS. 2A to 2H, an ink jet recording head was formed. Specifically, first, polymethyl isopropenyl ketone (produced by TOKYO OHKA KOGYO CO., LTD. under the trade name of ODUR-1010) was applied at a thickness of 15 μm onto the substrate 1 having the energy-generating elements 2 provided thereon (FIG. 2A). Then, the soluble resin layer 3 including the flow path mold pattern 3*a* and the base pattern 3*b* which was arranged and shaped to surround the flow path mold pattern was formed by a Deep-UV exposure apparatus (produced by USHIO INC. under the trade name of UX3000) (FIG. 2B). Then, a negative photosensitive resin having a composition shown in Table 1 was applied onto the soluble resin layer 3 at a thickness of 55 μm from the surface of the substrate 1. The solvent was dried (prebaked) at 90° C. for five minutes to form the negative photosensitive resin layer 4 (FIG. 2C).

TABLE 1

| | | |
|---|---|---|
| Epoxy Resin | Trade Name: EHPE-3150, Produced By Daicel Corporation | 100 parts by mass |
| Additive | Trade Name: 1,4-HFAB, Produced By Central Glass Co., Ltd. | 20 parts by mass |
| Cationic Polymerizable Initiator | Trade Name: SP-172, Produced By ADEKA CORPORATION | 6 parts by mass |
| Silane Coupling Agent | 3-Glycidoxypropyltrimethoxysilane | 5 parts by mass |
| Solvent | Xylene, Produced By KISHIDA CHEMICAL Co., Ltd. | 70 parts by mass |

Then, imprinting was used to form the depression 5 in the negative photosensitive resin layer 4 along the base pattern 3*b*. Specifically, first, the mold 14 with a projection pattern which had a bottom surface (pressing surface) along the base pattern having a width of 50 μm and had a trapezoidal cross section of a height of 5 μm was prepared (FIG. 2D). Then, the mold 14 was pressed against the negative photosensitive resin layer 4 so that the depth of the depression 5 at an inner edge position in the region to be the serrated groove 7 was 3 μm to form the depression 5 (FIG. 2E).

Figure 6A:
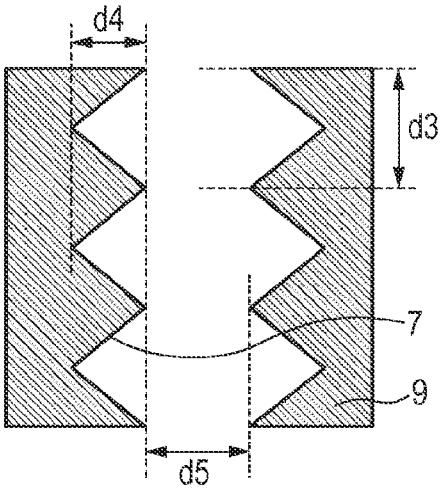
FIGS. 6A and 6B are schematic top views illustrating exemplary shapes of a groove and the ejection orifice, respectively, of the ink jet recording head of the embodiment.
Figure 6B:
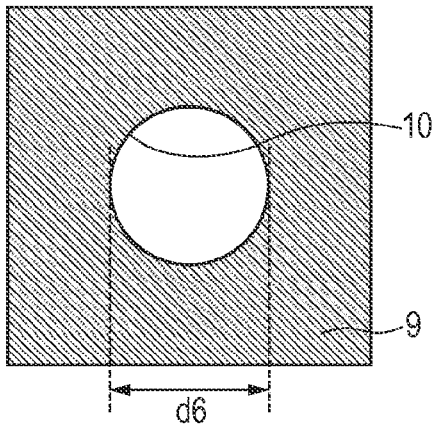

Then, the second latent image corresponding to the serrated groove and the first latent image corresponding to the ejection orifice were obtained through pattern exposure through the photomask 8 (FIG. 2F). In this case, as the exposure apparatus, an I-ray exposure stepper (produced by Canon Inc.) was used. The exposure light amount was 4,000 J/m$^2$. The focus of exposure was set at a position which was 5 μm away from the upper surface of the resin layer 4 toward the substrate 1. Then, heat treatment (PEB) was performed at 90° C. for four minutes, development was performed with a mixture solvent of methyl isobutyl ketone and xylene with the weight ratio being 1:1, and rinse treatment was performed with isopropyl alcohol to form the serrated groove and the ejection orifices (FIG. 2G). In this example, as illustrated in FIG. 6A, the serrated groove was formed which had multiple triangular protrusions on both sides thereof, with a width d3 being 20 μm and a length d4 being 14 μm, and with a width d5 between inner edges of the groove being 18 μm. Further, as illustrated in FIG. 6B, the ejection orifice 10 having a diameter d6 of 19 μm was formed (in FIG. 6A, the depression 5 is omitted).

Then, an etching mask (not shown) with a rectangular opening having a width of 1 mm was formed on a rear surface of the substrate 1 using a polyether amide resin composition (produced by Hitachi Chemical Company, Ltd. under the trade name of HIMAL). Then, the substrate 1 was soaked in a tetramethylammonium hydroxide aqueous solution of 22 wt % which was held at 80° C. and anisotropic etching of the substrate was performed to form the ink supply port 13. Note that, in this case, for the purpose of protecting, against the etchant, the resin layer on the surface of the substrate 1, a protective film (not shown, produced by TOKYO OHKA KOGYO CO., LTD. under the trade name of OBC) was applied onto the surface of the substrate 1 before the anisotropic etching was performed.

Then, after the protective film was dissolved and removed using xylene, a Deep-UV exposure apparatus (produced by USHIO INC. under the trade name of UX-3000) was used to perform whole surface exposure. After that, soakage in methyl lactate was performed with ultrasonic waves being applied to dissolve and remove the soluble resin layer 3. In this way, the flow path forming member 9 having the liquid flow path 12 formed therein was formed (FIG. 2H).

Then, heat treatment at 200° C. for 60 minutes was performed to completely cure the flow path forming member. Through a cutting and separating step, a chip sized to be 2 mm×20 mm was obtained (not shown). After that, a member for supplying ink (not shown) was bonded and electrical connection for driving the energy-generating element 2 (not shown) was made to complete the ink jet recording head.

Comparative Example 1

An ink jet recording head was formed similarly to the case of Example 1 except that the step of forming the depression 5 (FIGS. 2D and 2E) was omitted and the depression 5 was not formed.

Comparative Examples 2 and 3

Ink jet recording heads were formed similarly to the case of Example 1 except that the step of forming the depression 5 was omitted and the position of the focus of exposure was changed as shown in Table 2.

The ink jet recording heads obtained in Examples 1 to 6 and Comparative Examples 1 to 3 were evaluated as follows.

Evaluation 1: Blade Durability

Each of the ink jet recording heads which were formed was mounted to a printer. After an abrasion test of the blade was repeated 2,000 times by ejecting ink and performing recovery, the state of the blade and the wet state of the ejection surface were observed. The result is shown in Table 2. The criteria of the evaluation are as follows.

A: No local wear on the blade was observed, and the wet state of the ejection surface was almost uniform.

B: Slight local wear on the blade was observed, but the wet state of the ejection surface was almost uniform.

C: Local wear on the blade was observed, and a wet region which was thought to be left unwiped was observed on the ejection surface.

Evaluation 2: Ejection Orifice Accuracy

The areas of all the ejection orifices of each of the ink jet recording heads which were formed were measured. The result of evaluation of the accuracy of the ejection orifice is shown in Table 2. The criteria of the evaluation are as follows.

A: Variations in the areas of the ejection orifices were ±10% or less with reference to an average of the areas of the ejection orifices.

B: Variations in the areas of the ejection orifices were more than ±10% and ±15% or less with reference to an average of the areas of the ejection orifices.

C: Variations in the areas of the ejection orifices were more than ±15% with reference to an average of the areas of the ejection orifices.

The result of the evaluation is shown in Table 2.

TABLE 2

| | Example 1 | Example 2 | Example 3 | Example 4 | Example 5 | Example 6 | Comparative Example 1 | Comparative Example 2 | Comparative Example 3 |
|---|---|---|---|---|---|---|---|---|---|
| Depression Depth [μm]*1 | 3 | 3 | 3 | 1 | 5 | 3 | 0 (no depression) | 0 (no depression) | 0 (no depression) |
| Focus Of Exposure [μm]*2 | −5 | 0 | −10 | −5 | −5 | −15 | −5 | −15 | −30 |
| Blade Durability | A | A | A | A | A | A | C | C | B |
| Ejection Orifice Accuracy | A | A | A | A | A | B | A | B | C |

*1the depth of the depression formed in the negative photosensitive resin layer along the base pattern

*2expressed as positive in a direction from the substrate toward the upper surface of the resin layer with reference to the upper surface of the resin layer Examples 2 to 6

Ink jet recording heads were formed similarly to the case of Example 1 except that the position of the focus of exposure and the depth of the depression 5 were changed as shown in Table 2.

Examples according to another embodiment of the present invention are described in the following to describe the present invention in more detail.

Further, examples using a different thickness T2 of the ejection orifice plate and a different diameter of the ejection orifices from those in Examples 1 to 6 are described in the following to describe the present invention in more detail.

Example 7

An ink jet recording head was formed according to the embodiment illustrated in FIGS. 3A to 3H. Portions except the region in which the first depression 5 to form the groove was to be formed and the region in which the second depression 15 to form the ejection orifice was to be formed were exposed through the photomask 6 (FIG. 3D). In this case, as the exposure apparatus, an I-ray exposure stepper (produced by Canon Inc. under the trade name of i5) was used. The exposure light amount was 2,000 J/m$^2$. Further, heat treatment (PEB) was performed at 100° C. for four minutes. In this way, the first depression 5 and the second depression 15 were formed (FIG. 3E). The depth of the formed first depression 5 was measured with a laser microscope (produced by KEYENCE CORPORATION). The depth of the first depression 5 at an inner edge position in at least the region to be the serrated groove 7 was 3 μm. Other steps were performed similarly to those in Example 1, and the ink jet recording head was formed.

Example 8

The thickness of the applied resin, the ejection orifice diameter, the position of the focus of exposure, and the chip size were changed from those in Example 1. In the step illustrated in FIG. 2B, the thickness of polymethyl isopropenyl ketone (produced by TOKYO OHKA KOGYO CO., LTD. under the trade name of ODUR-1010) which was applied was 10 μm. In the step illustrated in FIG. 2C, the negative photosensitive resin was applied onto the soluble resin layer 3 at a thickness of 25 μm from the surface of the substrate 1 (the thickness T2 of the ejection orifice plate was 15 μm), and the solvent was dried (prebaked) at 60° C. for nine minutes. In the step illustrated in FIG. 2E, the depth of the depression 5 at an edge position in the region to be the serrated groove 7 was 3 μm. In the step illustrated in FIG. 2F, the focus of exposure was set at a position which was 5 μm away from the upper surface of the resin layer toward the substrate 1. Note that, an ejection orifice having a diameter of 12 μm was formed. In the step of cutting and separating the chips, a chip sized to be 12 mm×15 mm was obtained. Other steps were performed similarly to those in Example 1, and the ink jet recording head was formed.

Examples 9 to 11

Ink jet recording heads were formed similarly to the case of Example 8 except that the position of the focus of exposure and the depth of the first depression 5 were changed as shown in Table 3.

Example 12

The process for forming the depression 5 was changed from that in Example 8, and the ink jet recording head was formed according to the embodiment illustrated in FIGS. 3A to 3H. Portions except the region in which the first depression 5 to form the groove was to be formed and the regions in which the second depressions 15 to form the ejection orifice was to be formed were exposed through the photomask 6 (FIG. 3D). In this case, as the exposure apparatus, an I-ray exposure stepper (produced by Canon Inc. under the trade name of i5) was used. The exposure light amount was 2,000 J/m$^2$. Further, heat treatment (PEB) was performed at 100° C. for four minutes. In this way, the first depression 5 and the second depression 15 were formed (FIG. 3E). The depth of the formed first depression 5 was measured with a laser microscope (produced by KEYENCE CORPORATION). The depth of the first depression 5 at an inner edge position in the region to be the serrated groove 7 was 3 μm. Other steps were performed similarly to those in Example 7, and the ink jet recording head was formed.

Comparative Example 4

An ink jet recording head was formed similarly to the case of Example 8 except that the step of forming the depression 5 was omitted and the depression 5 was not formed.

The result of evaluation similar to that shown in Table 2 is shown in Table 3.

TABLE 3

| | Example 7 | Example 8 | Example 9 | Example 10 | Example 11 | Example 12 | Comparative Example 4 |
|---|---|---|---|---|---|---|---|
| Depression Depth [μm] | 3 | 3 | 3 | 1 | 5 | 3 | 0 (no depression) |
| Focus Of Exposure [μm] | −5 | −5 | 0 | −5 | −5 | −5 | −5 |
| Blade Durability | A | A | A | A | A | A | C |
| Ejection Orifice Accuracy | A | A | A | A | A | A | A |

As shown in Table 2 and Table 3, according to the embodiments of the present invention, a liquid ejection head with less liability to cause image disorder even in prolonged use can be provided. Further, by adjusting the position of the focus of exposure, the multiple ejection orifices in a chip and in the same wafer can be formed so as to have an accurate diameter.

With the structure of the present invention, it is possible to provide the liquid ejection head having the serrated groove with less wear on the blade and with less liability to cause image disorder even in prolonged use, and the process for producing the same.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-060009, filed Mar. 22, 2013, which is hereby incorporated by reference herein in its entirety.

What is claimed is:

1. A liquid ejection head, comprising:

a substrate on a surface of which an energy-generating element for generating energy for ejecting liquid is formed; and a flow path forming member formed on the substrate, the flow path forming member forming an ejection orifice for ejecting the liquid and a liquid flow path communicating with the ejection orifice, wherein the flow path forming member includes, at a position surrounding the liquid flow path, first and second depressions that open to an upper surface of the flow path forming member and a groove that opens to the first depression, the ejection orifice opening to the second depression, an angle between the upper surface of the flow path forming member and a slope surface of the first depression on the flow path forming member side is an obtuse angle, and the groove has a serrated side wall.

2. A liquid ejection head according to claim 1, wherein the groove has a tapered shape in which an area of a cross-section thereof becomes smaller from the surface of the substrate toward the upper surface of the flow path forming member.

3. A liquid ejection head according to claim 1, wherein the ejection orifice has a tapered shape in which an area of a cross-section thereof becomes smaller from the surface of the substrate toward the upper surface of the flow path forming member.

4. A liquid ejection head, comprising:

a substrate on a surface of which an energy-generating element for generating energy for ejecting liquid is formed; and a flow path forming member formed on the substrate, the flow path forming member forming an ejection orifice for ejecting the liquid and a liquid flow path communicating with the ejection orifice, wherein the flow path forming member includes, at a position surrounding the liquid flow path, a depression that opens to an upper surface of the flow path forming member and a groove that opens to the depression, an angle between the upper surface of the flow path forming member and a slope surface of the depression on the flow path forming member side is an obtuse angle, the groove has a serrated side wall, and the ejection orifice has a projection provided therein.

5. A liquid ejection head according to claim 4, wherein the groove has a tapered shape in which an area of a cross-section thereof becomes smaller from the surface of the substrate toward the upper surface of the flow path forming member.

6. A liquid ejection head according to claim 4, wherein the flow path forming member has a second depression which opens to the upper surface of the flow path forming member, and the ejection orifice opens to the second depression.

7. A liquid ejection head according to claim 6, wherein the ejection orifice has a tapered shape in which an area of a cross-section thereof becomes smaller from the surface of the substrate toward the upper surface of the flow path forming member.

* * * * *